US008302893B2

(12) United States Patent
Waznys et al.

(10) Patent No.: US 8,302,893 B2
(45) **Date of Patent: *Nov. 6, 2012**

(54) CONICAL-SHAPED IMPACT MILL

(75) Inventors: Peter J. Waznys, Centerport, NY (US); Josef Fischer, Bobingen (DE); Anthony M. Cialone, Naples, FL (US)

(73) Assignee: Lehigh Technologies, Inc., Tucker, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/983,805

(22) Filed: Jan. 3, 2011

(65) Prior Publication Data

US 2011/0095112 A1 Apr. 28, 2011

Related U.S. Application Data

(63) Continuation of application No. 12/146,138, filed on Jun. 25, 2008, now Pat. No. 7,861,958, which is a continuation-in-part of application No. 11/784,032, filed on Apr. 5, 2007, now Pat. No. 7,900,860.

(51) Int. Cl.
*B02C 13/28* (2006.01)

(52) U.S. Cl. ..... 241/261.1; 241/286

(58) Field of Classification Search ..... 241/261.1, 241/286

See application file for complete search history.

(56) References Cited

U.S. PATENT DOCUMENTS

| | | | | |
|---|---|---|---|---|
| 31,492 | A | 2/1861 | Stewart | |
| 2,738,930 | A * | 3/1956 | Schneider | 241/162 |
| 4,634,061 | A | 1/1987 | Williams | |
| 8,132,751 | B2 * | 3/2012 | Waznys et al. | 241/154 |
| 2009/0134257 | A1 | 5/2009 | Waznys et al. | |

FOREIGN PATENT DOCUMENTS

| | | | |
|---|---|---|---|
| DE | 2736349 | A1 | 2/1979 |
| DE | 9313930 | U1 | 11/1993 |
| DE | 9309448 | U1 | 11/1994 |

* cited by examiner

*Primary Examiner* — Mark Rosenbaum

(74) *Attorney, Agent, or Firm* — Morris, Manning & Martin, LLP; John R. Harris, Esq.; Daniel E. Sineway, Esq.

(57) ABSTRACT

An impact mill including a base portion on which is disposed a rotor rotatably mounted in a bearing housing, the rotor having an upwardly aligned cylindrical surface portion coaxial with the rotational axis. The impact mill is provided with a mill casing within which is located a conical track assembly which surrounds the rotor to form a conical grinding path. The mill casing is provided with a downwardly aligned cylindrical collar which may be axially adjusted to set a grinding gap between the rotor and the mill casing. The rotor is provided with a plurality of impact knives complementary with a plurality of impact knives disposed on the inside top surface of the mill casing. The conical track assembly can be a series of assembled conical sections or one unit with varied number of serrations in either a vertical or sloped configuration. This flexibility allows for greater compatibility with the feedstock being milled.

18 Claims, 7 Drawing Sheets

FIG. 6
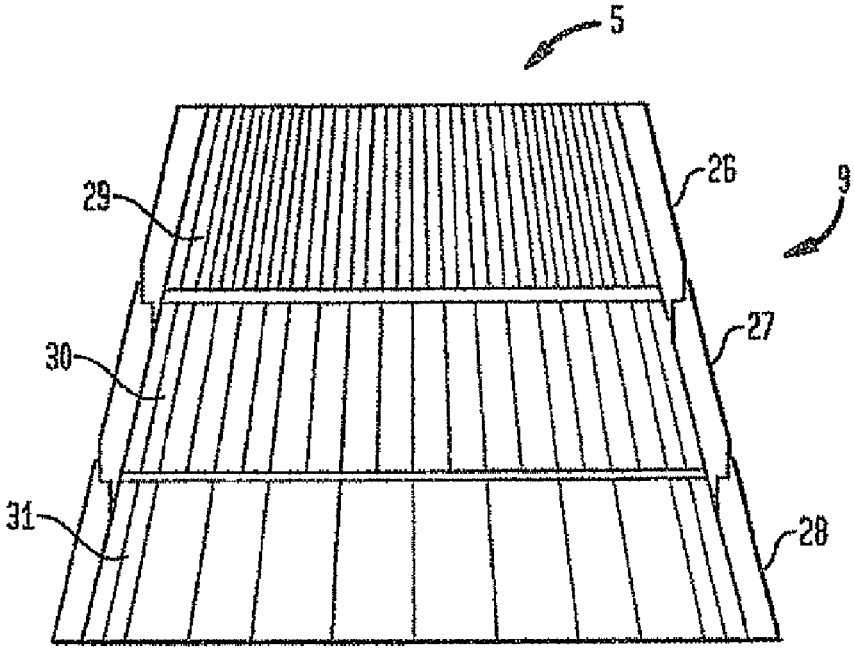
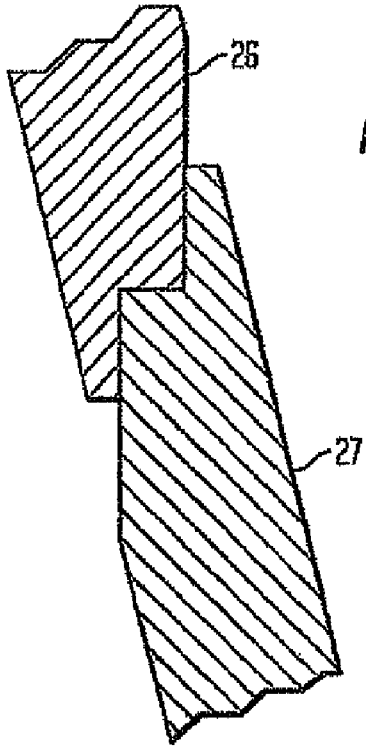
FIG. 7

CONICAL-SHAPED IMPACT MILL

CROSS REFERENCE TO RELATED APPLICATIONS

This application is a continuation application and claims the benefit of and priority under 35 U.S.C. §120 to U.S. patent application Ser. No. 12/146,138, filed Jun. 25, 2008, entitled "Conical-Shaped Impact Mill", by Peter J. Waznys et al., now U.S. Pat. No. 7,861,958, which is a continuation-in-part application of U.S. patent application Ser. No. 11/784,032, filed Apr. 5, 2007 now U.S. Pat. No. 7,900,860, entitled "Conical-Shaped Impact Mill", both of which are hereby incorporated by reference in their entireties and made a part hereof

BACKGROUND OF THE INVENTION

1. Field of Invention

The present invention is directed to a device for comminution of solids. More particularly, the present invention relates to a conically-shaped impact mill.

2. Description of the Prior Art

Devices for providing comminution of particulate solids are well known in the art. Amongst the many different milling devices known in the art grinding mills, ball mills, rod mills, impact mills and jet mills are most often employed. Of these, only jet mills do not rely on the interaction between the particulate solid and another surface to effectuate particle disintegration.

Jet mills effectuate comminution by utilization of a working fluid which is accelerated to high speed using fluid pressure and accelerated venturi nozzles. The particles collide with a target, such as a deflecting surface, or with other moving particles in the chamber, resulting in size reduction. Operating speeds of jet milled particles are generally in the 150 and 300 meters per second range. Jet mills, although effective, cannot control the extent of comminution. This oftentimes results in the production of an excess percentage of undersized particles.

Impact mills, on the other hand, rely on centrifugal force, wherein particle comminution is effected by impact between the circularly accelerated particles, which are constrained to a peripheral space, and a stationary outer circumferential wall. Again, although control of particle size distribution is improved and can be manipulated compared to jet mills, the particle size range of the comminuted product of an impact mill is fixed by the dimensions of the device and other operating parameters.

A major advance in impact mill design is provided by a design of the type disclosed in German Patent Publication 2353907. That impact mill includes a base portion which carries a rotor, mounted in a bearing housing having an upwardly aligned cylindrical wall portion coaxial with the rotational axis, and a mill casing which surrounds the rotor, defining a conical grinding path. The mill of this design includes a downwardly aligned cylindrical collar which may be displaced axially in the cylindrical wall portion and may be adjusted axially to set the grinding gap between the rotor and the grinding path.

An example of such a design is set forth in European Patent 0 787 528. The invention of that patent resides in the capability of dismantling the mill casing from the base portion in a simple manner.

Although impact mills having conical shapes, permitting a downwardly aligned cylindrical collar to be displaced axially so that the grinding gap may be adjusted, represents a major advance in the art, still those designs can be improved by further design improvements that have not heretofore been addressed.

Impact mills, when utilized in the communition of elastic particles, such as rubber, are usually operated at cryogenic temperatures, utilizing cryogenic fluids, in order to make feasible effective comminution of the otherwise elastic particles. Commonly, cryogenic fluids, such as liquid nitrogen, are utilized to make brittle such elastic solid particles. In view of the fact that the cryogenic temperatures attained by the frozen particles are much lower than the ambient surrounding temperature of the mill, this temperature gradient results in a rapid temperature rise of the particles. As a result, it is apparent that maximum comminution in an impact mill, or any other mill, should begin immediately after particles freezing. However, impact mills, including the conically shaped design discussed supra, initially require the particles to move outwardly toward the periphery before comminution begins. During that period the temperature of the particles is increased, reducing comminution effectiveness.

Another problem associated with comminution mills in general and conical mills of the type described above in particular is the inability to alter the physical configuration of the impact mill to adjust for specific particle size requirements of the various materials.

Three expedients are generally utilized to change the particle size of an elastic solid whose initial size is fixed.

The first expedient employed in changing particle size is changing the feedstock temperature by contact with a cryogenic fluid, e.g. liquid nitrogen, to freeze the elastic solid particles to a crystalline state. The coldest temperature achievable by the particles is limited to the temperature of the cryogenic fluid. A means of controlling particle temperature is to adjust the quantity of cryogenic fluid delivered to the elastic solid particles.

A second expedient of changing product particle size is to alter the peripheral velocity of the rotor. This is usually difficult or impractical given the physical limits of the impact mill design.

A third expedient of altering particle size is to change the grinding gap between the impact elements. Generally, this step requires a revised rotor configuration.

An associated problem, related to alteration of rotor configuration in order to effect changes in desired product particle size, is ease of replacement of worn or damaged portions of the impact mill. As in the case of replacement of parts of any mechanical device, problems are magnified in proportion to the size and complexity of the part being replaced.

Yet another problem associated with impact mills resides in power transmission to effectuate rotation of the rotor. Present designs employ multiple belt or gear power transmission means which are oftentimes accompanied by unacceptable noise levels. A corollary of this problem is that if power transmission speeds are reduced to abate excessive noise, rotor speed is reduced so that comminution results are unacceptable. It is thus apparent that a method of improved power transmission, unaccompanied by unacceptable loud noise, is essential to improved operation of impact mills.

BRIEF SUMMARY OF THE INVENTION

A new impact mill has now been developed which addresses problems associated with conically-shaped impact, adjustable gap comminution mills of the prior art.

The impact mill of the present invention provides means for initiation of comminution of solid particles therein at a lower cryogenic temperature than heretofore obtainable. That is, comminution in the impact mill of the present invention is initiated at the point of introduction of the solid particles into the impact mill even before the particles reach the grinding path formed between the rotor and the stationary mill casing utilizing the lowest particle temperature. Therefore, comminution efficiency is maximized.

In accordance with the present invention, an impact mill is provided which includes a base portion upon which is disposed a rotor rotatably mounted in a bearing housing. The conical shaped rotor has an upwardly aligned conical surface portion coaxial with the rotational axis. A plurality of impact knives are mounted on the conical surface. The impact mill is provided with an outer mill casing within which is located a conical track assembly which surrounds the rotor. The mill casing has a downwardly aligned cylindrical collar which may be axially adjusted to set a grinding gap between the rotor and the grinding track assembly. The top surface of the rotor is provided with a plurality of impact knives complimentary with a plurality of stationary impact knives disposed on the top inside surface of the mill casing.

The impact mill of the present invention also addresses the issue of adjustability of comminution of different sizes and grades of selected solids. This problem is addressed by providing segmented internal conical grinding track sections which are provided with variable impact knive configurations. This solution also addresses maintenance and replacement issues.

In accordance with this embodiment of the present invention an impact mill is provided in which a base portion disposed beneath a rotor rotatably mounted in a bearing housing. The conical shaped rotor has an upwardly aligned conical surface portion coaxial with a rotational axis. A plurality of impact knives are mounted on the conical surface. The impact mill is provided with an outer mill casing which supports a conical grinding track assembly which surrounds the rotor. The mill casing has a downwardly aligned cylindrical collar which may be axially adjusted to set a grinding gap between the rotor and the grinding track assembly wherein the mill casing is formed of separate conical sections.

In further accordance with the present invention, the internal grinding track assembly may be composed of separate conical sections. This embodiment permits the selection of alternate tooth configurations through a series of interlocking frustum cones. Each cone assembly configuration is selected to match a particular feedstock characteristic or desired comminuted end product. An ergonomic feature of this embodiment allows the replacement of worn or damaged frustum conical cones without the necessity of replacing the entire grinding track assembly. Each section of the grinding track assembly can increase or decrease the number of impacts with any peripheral velocity of rotary knives thus providing a matrix of operating parameters.

In another embodiment, the changing of the shape and angle of the conical grinding track assembly alters particle direction and provides additional particle-to-particle collisions. Specifically, a grinding track assembly with negative sloped serrations, with respect to the rotational axis, decreases comminution whereas a positive slope increases comminution.

The impact mill of the present invention also addresses the issue of effective power transmission without accompanying noise pollution.

In accordance with a further embodiment of the present invention an impact mill is provided with a base portion upon which is disposed a rotor rotably mounted in a bearing assembly. The conical shaped rotor has an upwardly aligned conical surface portion coaxial with the rotational axis. A plurality of impact knives are mounted on the conical surface. The impact mill is provided with an outer mill casing which supports a conical grinding track assembly which surrounds the rotor. The mill casing has a downwardly aligned cylindrical collar which may be axially adjusted to set a grinding gap between the rotor and the grinding track assembly. To mitigate belt slippage and excessive noise when operating at high speeds, the rotor shaft of the impact mill is provided with a sprocketed drive sheave wherein the rotor is rotated by a synchronous sprocketed belt, in communication with a power source, accommodated on the sprocketed drive sheave.

BRIEF DESCRIPTION OF THE DRAWINGS

The present invention may be better understood by reference to the accompanying drawings of which:

FIG. 6 is a sectional view of an embodiment of a rotor of an outer concentric grinding track of the impact mill;

FIG. 7 is a sectional view showing alignment of a typical interconnected grinding track;

DETAILED DESCRIPTION

Figure 1:
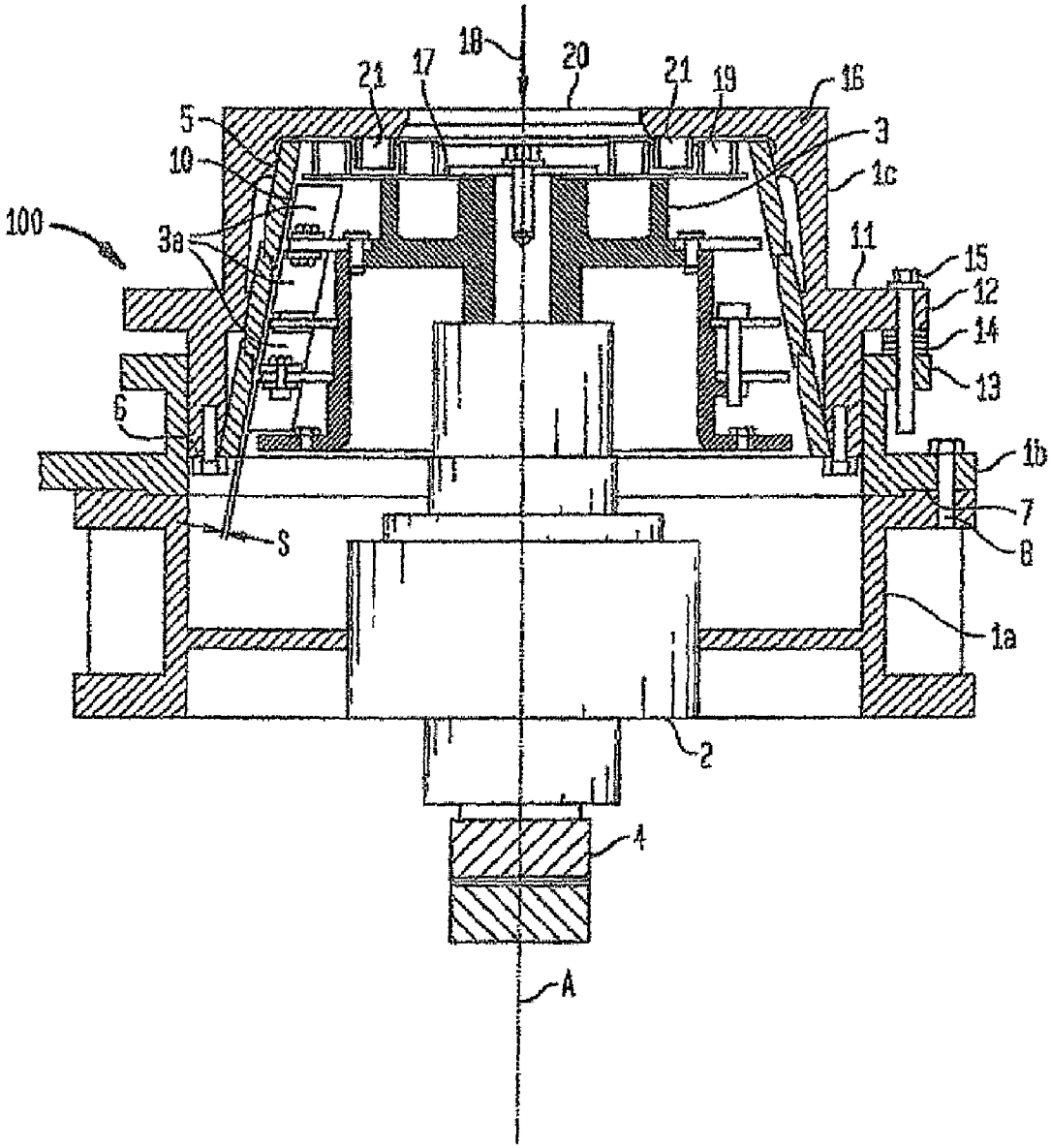
FIG. 1 is an axial sectional view of the impact mill of the present invention.
Figure 2:
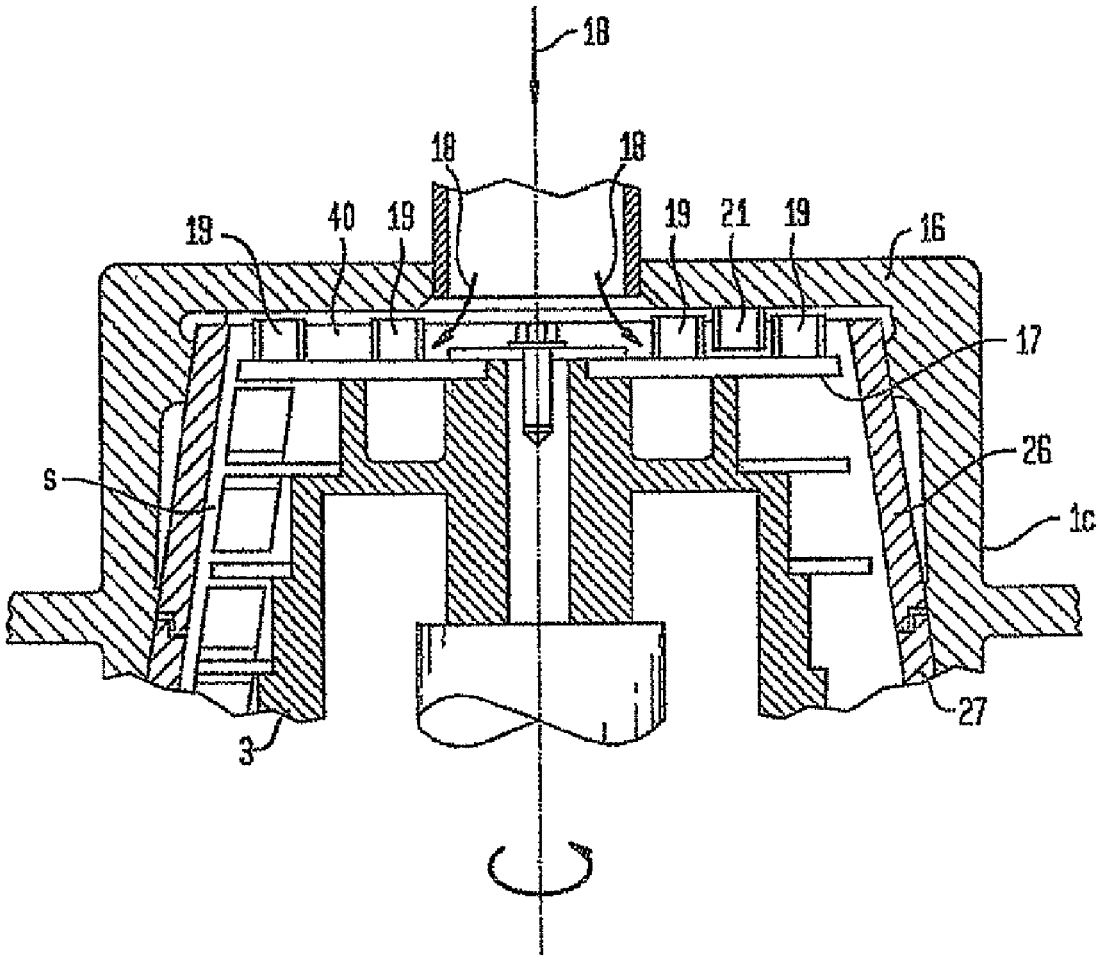
FIG. 2 is an axial sectional view of a portion of the impact mill demonstrating feedstock introduction therein.
Figure 3:
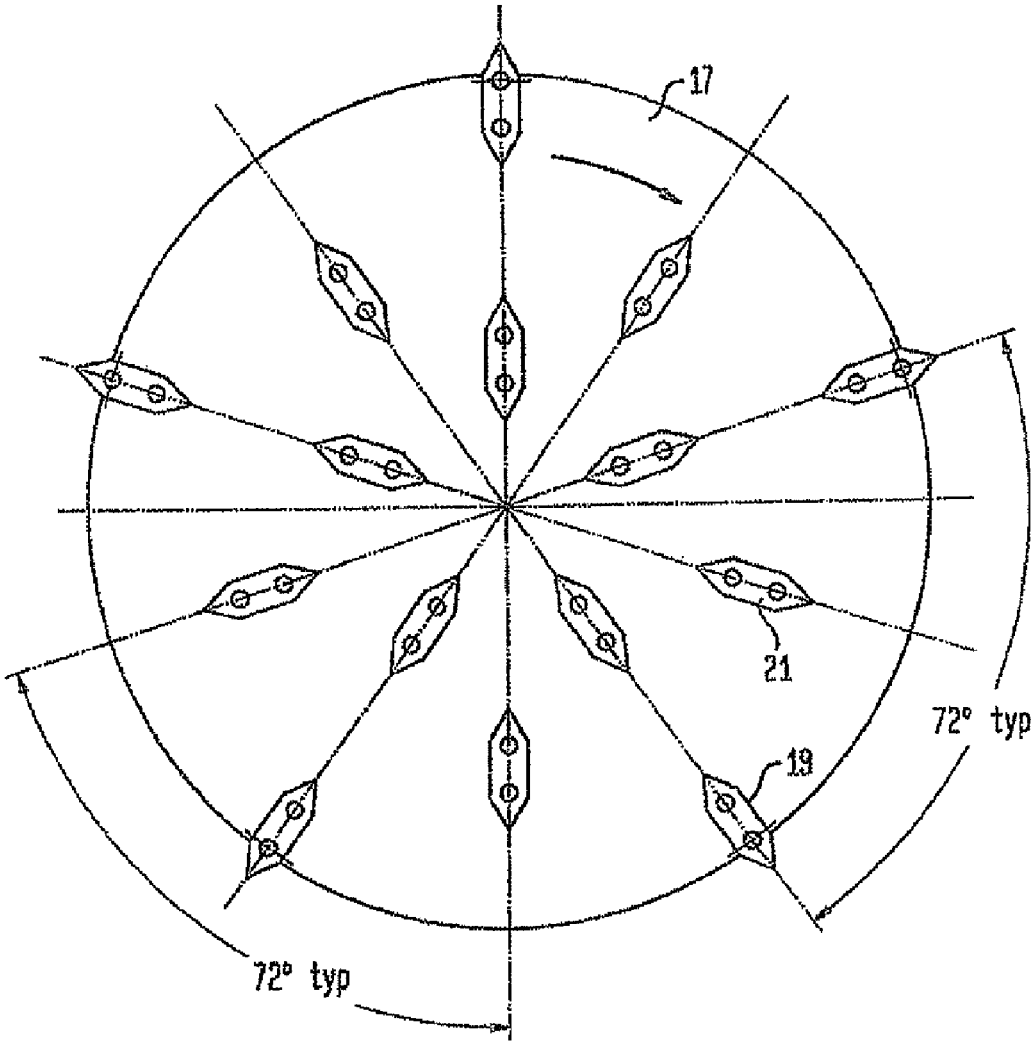
FIG. 3 is a plan view of impact knives disposed on the top of the upper housing section of the impact mill and on the top of the rotor.
Figure 4A:
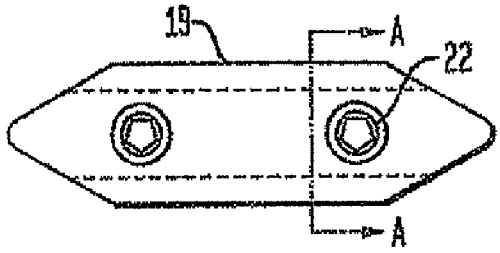
FIGS. 4*a*, 4*b* and 4*c* are plan views of rotating and stationary impact knife arrays of alternate configurations shown in FIG. 3.
Figure 4B:
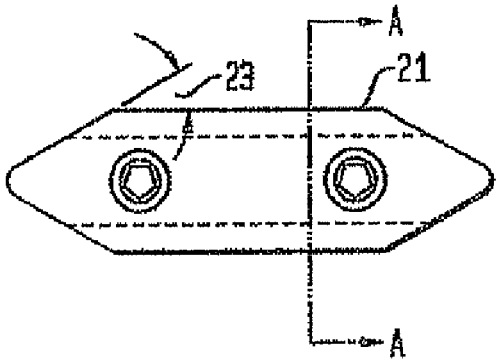
Figure 4C:
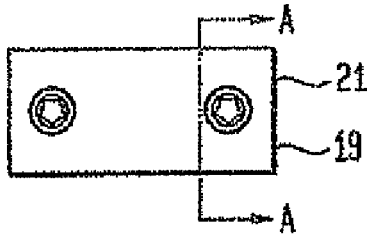
Figure 5A:
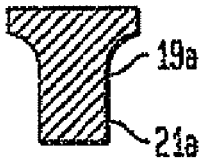
FIGS. 5*a*, 5*b* and 5*c* are cross sectional views, taken along plane A-A of FIGS. 4*a* and 4*b*, demonstrating three impact knife designs.
Figure 5B:
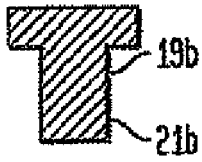
Figure 5C:
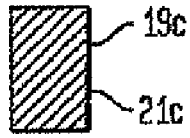
Figure 8:
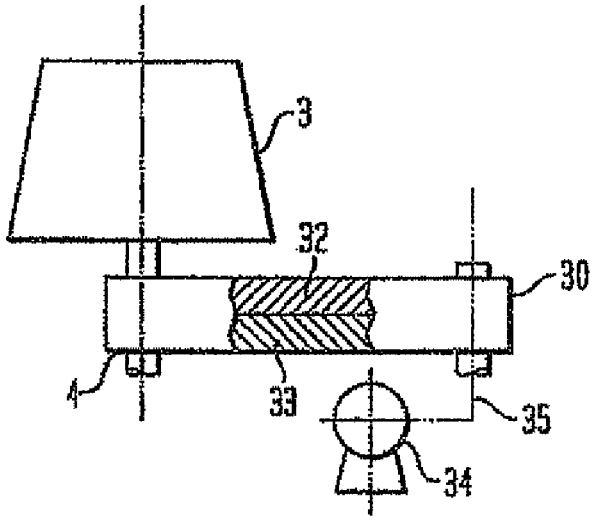
FIG. 8 is a schematic representation of a transmission means for rotating the rotor of the impact mill.
Figure 9:
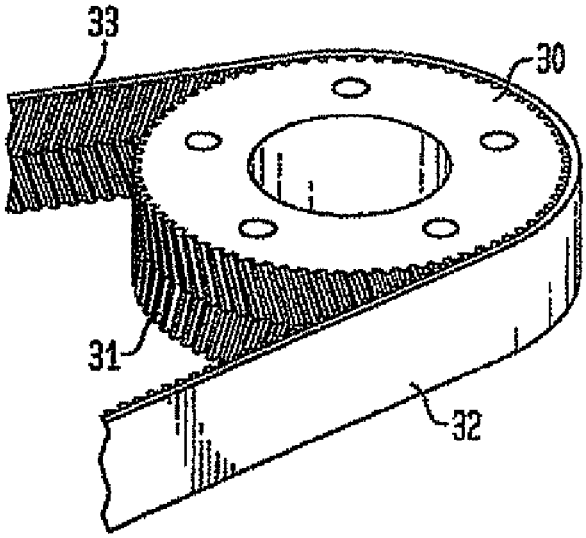
FIG. 9 is an isometric view of a synchronous belt and a sprocketed drive sheave in communication with said belt utilized in the transmission of power to the impact mill.

An impact mill 100 includes three housing sections: a lower base portion section 1*a*, a center housing section 1*b* and a top housing section 1*c*. The lower base portion section 1*a* carries a bearing housing 2 in which a rotor 3 is rotatably mounted. The center housing section 1*b* is concentrically nested 7 in the lower housing section 1*a* and provides concentric vertical alignment for the upper housing section 1*c*. A plurality of bolts 8 is provided for the detachable connection of the two housing sections. The top housing section 1*c* provides a concentric tapered nest for a conical grinding track assembly 5. The conical grinding track assembly 5 is securely connected to the top housing section 1*c* at its lower end 6. The rotor 3 is driven by a motor 34 by means of a belt 32 and a sheave 4 provided at the lower end of the rotor shaft.

The top section 1*c* includes the conical grinding track assembly 5. The grinding track assembly 5 has the shape of a truncated cone. Grinding track assembly 5 surrounds rotor 3 such that a grinding gap S is formed between grinding knives 3*a* fastened to rotor 3 and the grinding track assembly 5. The top section 1*c* also includes a downwardly aligned cylindrical collar 11 which may be displaced axially within the center housing section 1*b*. The cylindrical collar 11 forms an integral component of the top section 1*c*. An outwardly aligned flange 12 is provided at the upper end of the cylindrical collar 11. A plurality of spacer blocks 14 is disposed between flange 12 and a further flange 13 which is disposed at the upper end of center section 1*b*. Thus, spacer blocks 14 define the axial setting between flanges 12 and 13. Therefore, spacer blocks 14 define the width of the grinding gap S. As such, this width is adjustable. Once the desired grinding gap S is set, the top section 1*c* is securely fastened to the center section 1*b* by means of a plurality of bolts 15. The upper section 1*c* and the grinding track assembly 5 are disposed coaxially with the rotor axis A.

Cryogenically frozen feedstock 18 enters the impact mill 100 through entrance 20 by means of a path, defined by top 16 of upper housing section 1*c*, which takes the feedstock 18 to a labyrinth horizontal space 40 between the upper section 1*c* and rotor 3. Feedstock 18 moves to the peripheral space defined by gap S by means of centrifugal force through a path defined by the inner housing surface of the top 16 of the upper housing section 1*c* and the top portion 17 of rotor 3. The feedstock 18 is at its minimum temperature as it enters horizontal space 40. Thus, impact knives 19, connected to the top portion 17 of rotor 3, as well as the stationary impact knives 21, disposed on the inner housing surface of the top 16 of upper housing section 1*c*, provide immediate comminution of the feedstock 18, which in prior art embodiments were subject to later initial comminution in the absence of the plurality of impact knives 19 and 21.

In a preferred embodiment, illustrated by the drawings, impact knives 19 and 21 are disposed in a radial direction outwardly from axial rotor A to the circumferential edge on the top portion 17 of rotor 3 and the inner housing surface of top 16 of top housing section 1*c*. It is preferred that three to seven knife radii be provided. In one particularly preferred embodiment, impact knives 21 are radially positioned on the inner housing surface of top 16 of the top housing section 1*c* and impact knives 19 are positioned on top portion 17 of rotor 3 in five equiangular radii, 72° apart from each other. However, greater numbers of impact knives, such as six knive radii, 60° apart or seven knive radii, 51.43° apart, may also be utilized. In addition, a lesser number of impact knives, such as three knife radii, 120° apart, may similarly be utilized.

In a preferred embodiment, impact knives 21 and 19, disposed on the inner housing surface of top 16 of upper housing section 1*c* and the top portion 17 of rotor 3, respectively, are identical. Their shape may be any convenient form known in the art. For example, a tee-shape 21*b* or 19*b*, a curved tee-shape 21*a* or 19*a* or a square edge 21*c* or 19*c* may be utilized. The impact knives 21 and 19 may also have tapered tips to maximize impact efficiency. The taper may be any acute angle 23. An angle of 30°, for example, is illustrated in the drawings. Impact knives 19 are fastened to the top portion 17 of rotor 3 and impact knives 21 are fastened to the inner housing surface of top 16 of upper housing section 1*c*.

Frozen feedstock 18 is charged into mill 100 by means of a stationary funnel 24, which is provided at the center of inner housing surface of top 16 of upper housing section 1*c*. Feedstock 18 immediately encounters the top portion 17 of rotor 3 and is accelerated radially and tangentially. In this radial and tangential movement feedstock 18 encounters the plurality of stationary and rotating impact knives 21 and 19. This impact, effected by the rotating knives, shatters some of the radially accelerated feedstock 18 as it disturbs the flow pattern so that turbulent radial and tangential solid particle flow toward the stationary knives results. After impact in the aforementioned space, denoted by reference numeral 40, feedstock 18 continues its turbulent radial and tangential movement toward the series of rotating knives 3*a* mounted on the outer rim of the rotor 3. These impacts increase the tangential release velocity as feedstock 18 undergoes its final particle size reduction within conical grinding path 10 whose volume is controlled by gap S.

The conically shaped impact mill 100, in a preferred embodiment, utilizes a conical grinding track assembly formed of separate conical sections. This design advance permits a series of mating interlocking frustum cones to alter the grinding track pattern within mill 100. In this embodiment, each conical grinding track assembly section 5 is selected to match a particular feedstock or desired end product. Each section of the assembly 5 is provided with alternate impact configurations which provides capability of either increasing or decreasing the number of impacts to which feedstock 18 is subjected. That is, the number impact knife or serrations on the inside surface of each section of assembly 5 has different numbers of serrations. Obviously, the more serrations or impact surfaces, the greater the comminution effect. In addition, the adjustment of the shape and angle of the impact surfaces of the conical assembly sections 5 also permit alteration of the direction of the feedstock particles.

Another advantage of this preferred embodiment of mill 100 is economic. The replacement of worn or damaged conical sections, without the requirement of replacing the entire conical assembly, reduces maintenance costs.

Interconnection of the conical grinding track assembly sections 5 may be provided by any connecting means known in the art. One such preferred design utilizes key interlocks, as illustrated in FIG. 7. Therein, complementary shapes of sections 26 and 27 result in an interlocking assembly. Specifically, sections 26 and 27 are interlocking mating frustum cones.

In this preferred embodiment impact mill 100 is divided into a plurality of sections. The drawings illustrate a typical design, a plurality of three sections: a top section 26, a middle section 27 and a bottom section 28 with the grinding track assembly secured in place at its lower end 6. This configuration allows for the external adjustment of the grinding gap by adding or subtracting spacer blocks 14.

In an alternate embodiment of the present invention, the design of the conical grinding assembly, independent of whether it is a single unit or a series of mating interlocking subassemblies, is changed by altering the impact surfaces, e.g. serrations, of the stationary impact surfaces disposed on the inner surface of the conical grinding track assembly 5.

Unlike the stationary impact knifes 21 disposed on top 16 of housing section 1*c*, the conical grinding track assembly 5 impact surfaces are preferably serrated edges 41. These serrated edges 41 are normally aligned so that they are coaxial with the rotor axis A. That is, the projection of each serrated edge on a plane of the rotor axis is a straight line coincident with rotor axis.

A means of increasing or decreasing comminution is to increase or decrease, respectively, time duration of feedstock 18 to traverse the grinding path 10. Obviously, the longer the grinding path 10, the longer the time to traverse that path between impact knives on rotor 3 and the serrated edges 41 of assembly 5, and the greater the degree of comminution. A means of increasing or decreasing path 10 is by changing the disposition of serrated edges 41 so that they become unaligned with the rotor axis A. The greater the slope of the line projected on a plane intersecting the rotor axis A, the greater is the time divergence with a path where the serrated edge is coincident with the rotor axis. That is, the greater the divergence in positive slope, in the direction of rotation, the longer the time to traverse path 10 and, in turn, the greater the degree of comminution, and vica versa. Reversing the direction of rotation for the same slope reduces the effective length of path 10 by the same degree as it is increased in the opposite direction and thus decreases comminution by the same degree.

Figure 10A:
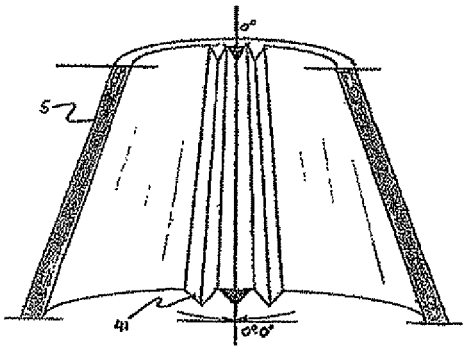
FIG. 10A is an isometric conical sectional view of the internal grinding track depicting three of the multitude of vertical serrations.
Figure 10C:
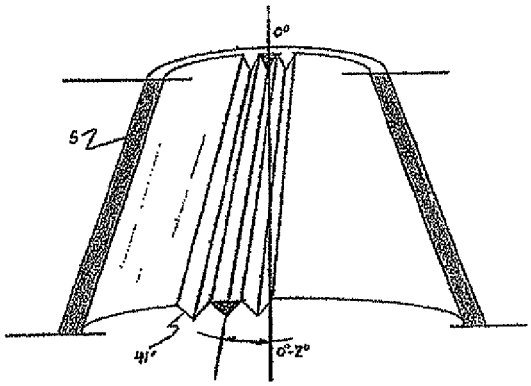
FIG. 10C is an isometric conical section of the internal grinding track depicting three of the multitude of sloped vertical serrations.
Figure 10B:
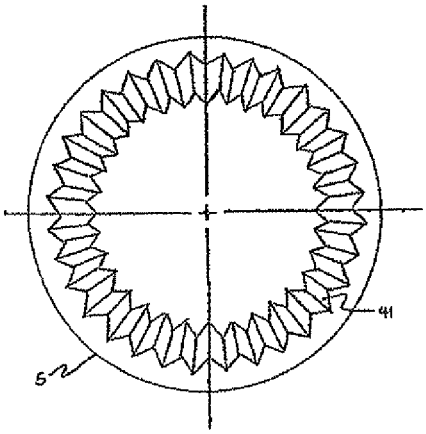
FIG. 10B is a plan view of the conical grinding track assembly, as viewed upwardly from the bottom, of the embodiment depicted in FIG. 10A.

This is illustrated by FIGS. 10A-10D. FIGS. 10A and 10B illustrate an isometric sectional view of the internal track assembly 5 depicting only three of the multitude of vertical serrations. As shown in FIG. 10A, the serrations are at a zero phase angle between the smaller top and larger bottom diameters. FIG. 10B shows this embodiment in plan viewed upwardly from the bottom.

Figure 10D:
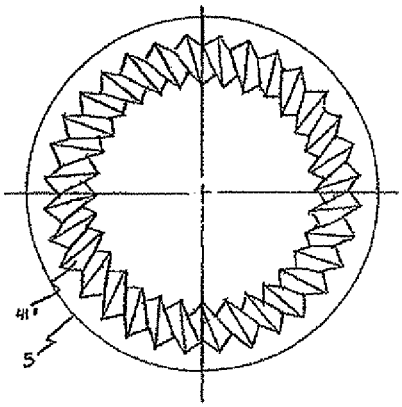
FIG. 10D is a plan view of the conical grinding track assembly as viewed upwardly from the bottom of another embodiment depicted in FIG. 10C.

FIG. 10C illustrates another embodiment where sloped serrations with an angle Z from the vertical replaces the 0° angle of the embodiment of FIG. 10A. FIG. 10D is the same view as FIG. 10B except for the serrations being in a sloped configuration.

That is illustrated by FIGS. 10A-10D. FIGS. 10A and B depict, in front and top views, conventional disposition of serrated edges 41 on the inner surface of the grinding track assembly 5. FIG. 10B illustrates that the rotor axis A and each serration 41 projects a coincident vertical line. As shown in that figure, the angle between those lines is 0°. FIGS. 10C and 10D are identical to FIGS. 10A and 10B illustrating disposition of serrated edges 41' at an angle Z from the rotor axis A.

In another embodiment of the present invention impact mill 100 includes a power transmission means which provides direct power transmission at lower noise levels than heretofore obtainable. In a typical design of the power transmission means to the mill 100 of the present invention, noise associated therewith is reduced by up to about 20 dbA. To provide this reduced noise level, without adverse effect on power transmission, a synchronous sprocketed belt 32, accommodated on a sprocketed drive sheave 4 on rotor 3, effectuates rotation of rotor 3. The belt 32 is in communication with a power source, such as engine 34, which rotates a shaft 35 that terminates at a sheave 30, identical to sheave 4. In a preferred embodiment, belt 32 is provided with a plurality of helical indentations 33 which engage helical teeth 31 on sheaves 4 and 30. The chevron-like design allows for the helical teeth 31 to gradually engage the sprocket instead of slapping the entire tooth all at once. Moreover, this design results in self-tracking of the drive belt and, as such, flanged sheaves are not required.

In operation, a power source, which may be engine 34, turns shaft 35 connected thereto. Shaft 35 is fitted with sheave 30, identical to sheave 4. The belt 32 communicates between sheaves 4 and 30, effecting rotation of rotor 3. Substantially all contact between belt 32 and sheaves 4 and 30 occurs by engagement of teeth 31 of the sheaves with grooves 33 of belt 32 which significantly reduces noise generation.

The above embodiments are given to illustrate the scope and spirit of the present invention. These embodiments will make apparent to those skilled in the art other embodiments. These other embodiments are within the contemplation of the present invention. Therefore, the present invention should be limited only by the appended claims.

What is claimed is:

1. An impact and grinding mill, comprising:

a base portion upon which is disposed a rotatable rotor, the rotor having a top surface and an upwardly aligned conical surface portion coaxial with a rotational axis of the rotor, the top surface of the rotor having a plurality of impact members protruding therefrom, wherein the plurality of impact members are staggered radially outwardly from the rotational axis of the rotor to a circumferential edge of the top surface;

a mill casing over said rotor, the mill casing including a conical track assembly that surrounds the rotor; and a plurality of serrated impact surfaces protruding from an inner surface of the conical track assembly.

2. The impact and grinding mill of claim 1, wherein the rotor is rotatably mounted in a bearing housing in the base portion.

3. The impact and grinding mill of claim 1, wherein the mill casing includes a downwardly aligned cylindrical collar that may be axially adjusted to set a grinding gap between the rotor and the conical track assembly.

4. The impact and grinding mill of claim 1, wherein a plurality of impact knives are disposed on the upwardly aligned conical surface portion of the rotor.

5. The impact and grinding mill of claim 1, wherein the plurality of serrated impact surfaces are positioned such that they form a slope relative to the rotational axis of the rotor.

6. The impact and grinding mill of claim 5, wherein the slope of the serrated impact surfaces is positive with respect to a direction of rotation of the rotor.

7. The impact and grinding mill of claim 5, wherein the slope of the serrated impact surfaces is negative with respect to a direction of rotation of the rotor.

8. The impact and grinding mill of claim 1, wherein the plurality of impact members protruding from the top surface of the rotor are equiradially disposed outwardly from the rotational axis of the rotor to the circumferential edge on the top surface of the rotor.

9. The impact and grinding mill of claim 1, wherein there are between three and seven radii of impact members equiradially disposed outwardly from the rotational axis of the rotor to the circumferential edge on the top surface of the rotor.

10. The impact and grinding mill of claim 1, wherein the conical track assembly comprises separate conical grinding track sections.

11. The impact and grinding mill of claim 10, wherein the separate conical grinding track sections are interlocked to form the conical track assembly.

12. The impact and grinding mill of claim 10, wherein the separate conical grinding track sections are interlocking mating frustum cones.

13. The impact and grinding mill of claim 10, wherein each of the separate conical grinding track sections include different configurations of serrated impact surfaces.

14. The impact and grinding mill of claim 1, further comprising a shaft that is attached to the rotor and is provided with a sprocketed drive sheave, wherein the rotor is rotated by a synchronous sprocketed belt, accommodated by the sprocketed drive sheave, the belt being in communication with a power source.

15. The impact and grinding mill of claim 14, wherein the synchronous belt includes helical grooves accommodated in the sprocketed sheave having helical offset teeth and a second identical sheave connected to the power source.

16. The impact and grinding mill of claim 15, wherein the helical grooves on the belt and the helical offset teeth are chevron-shaped.

17. The impact mill claim of 1, wherein each of the plurality of impact members comprise tapered edges to assist with comminution of feedstock.

18. The impact mill claim of 1, wherein the plurality of impact members comprise shapes selected from one or more of the following: tee-shape, curved tee-shape, rectangular shape, square shape.

* * * * *